US011761268B2

(12) United States Patent
Firth et al.

(10) Patent No.: US 11,761,268 B2
(45) Date of Patent: Sep. 19, 2023

(54) WELLHEAD PENETRATOR FOR ELECTRICAL CONNECTIONS

(71) Applicant: INNOVEX DOWNHOLE SOLUTIONS, INC., Houston, TX (US)

(72) Inventors: Gary Firth, Houston, TX (US); Brian Sneed, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 74 days.

(21) Appl. No.: 17/495,414

(22) Filed: Oct. 6, 2021

(65) Prior Publication Data

US 2022/0106840 A1 Apr. 7, 2022

Related U.S. Application Data

(60) Provisional application No. 63/088,714, filed on Oct. 7, 2020.

(51) Int. Cl.
*E21B 17/02* (2006.01)
*E21B 33/068* (2006.01)

(52) U.S. Cl.
CPC ..... *E21B 17/028* (2013.01); *E21B 33/068* (2013.01)

(58) Field of Classification Search
CPC ..... E21B 17/028; E21B 33/0407; E21B 33/0353; E21B 33/0385; E21B 33/068
See application file for complete search history.

(56) References Cited

U.S. PATENT DOCUMENTS 2,718,543 A * 9/1955 Lidderdale ..... H02G 15/14 174/77 R
3,188,118 A 6/1965 Jones
3,816,641 A * 6/1974 Iversen ..... H01R 13/523 174/76

(Continued)

FOREIGN PATENT DOCUMENTS

WO 95-21483 A1 8/1995

OTHER PUBLICATIONS

Seung Hoon Bahng (Authorized Officer), International Search Repod and Written Opinion dated Feb. 4, 2022, PCT Application No. PCT/US2021/053762, 11 pages.

(Continued)

*Primary Examiner* — D. Andrews
(74) *Attorney, Agent, or Firm* — MH2 TECHNOLOGY LAW GROUP LLP

(57) ABSTRACT

A wellhead penetrator includes a mandrel having first and second ends, a lock nut that is adjustably connected to the second end of the mandrel, a tapered bowl positioned within the lock nut, the mandrel, or both, and a cable lock assembly at least partially received into the mandrel and the lock nut. Moving the lock nut in an axial direction relative to the mandrel causes the cable lock assembly to grip a cable received therethrough. The penetrator also includes a sealing element positioned at least partially within the mandrel and spaced apart from the tapered bowl, and a backup member positioned adjacent to the sealing element and at least partially within the mandrel. The backup member presses against the sealing element so as to prevent misalignment of the sealing element, and the mandrel, the lock nut, the sealing element, and the backup member receive the cable therethrough.

24 Claims, 11 Drawing Sheets

(56) References Cited

U.S. PATENT DOCUMENTS

| | | | | |
|---|---|---|---|---|
| 3,945,700 | A | 3/1976 | Didier | |
| 4,583,804 | A * | 4/1986 | Thompson | H01R 13/533 439/588 |
| 4,693,534 | A | 9/1987 | Clark | |
| 4,995,646 | A | 2/1991 | Johnston et al. | |
| 10,280,701 | B2 | 5/2019 | Emerson | |
| 10,871,040 | B2 * | 12/2020 | Ames | E21B 17/0285 |
| 2014/0110164 | A1 | 4/2014 | Emerson et al. | |
| 2019/0218878 | A1 | 7/2019 | Sneed | |
| 2020/0291736 | A1 | 9/2020 | Emerson | |

OTHER PUBLICATIONS

Non-Final Office Action dated Feb. 22, 2023, U.S. Appl. No. 18/051,591, 15 pages.

* cited by examiner

WELLHEAD PENETRATOR FOR ELECTRICAL CONNECTIONS

CROSS-REFERENCE TO RELATED APPLICATIONS

This application claims priority to U.S. Provisional patent application having Ser. No. 63/088,714, which was filed on Oct. 7, 2020, and is incorporated herein by reference in its entirety.

BACKGROUND

Wellheads are connected to the top of a well and act as a surface termination for the well. Further, wellheads generally provide for a production tubing hanger to be installed therein. The production tubing extends downward from the hanger into the well. Produced fluid is received up through the production tubing and through the wellhead, e.g., via valves, rams, seals, and/or other surface equipment.

In many cases, a pump is installed along with the production tubing. The pump facilitates the removal of produced fluids (e.g., hydrocarbons) from the well up through the production tubing. The pump is generally electrically powered, and thus often referred to as an electric submersible pump or ESP.

A power cable is typically run from a power source at the surface (e.g., a generator or the power grid), along the production tubing, and down to the ESP. While this reliably and efficiently provides power to the ESP, extending the cable through the wellhead can present challenges. In particular, the environment within the wellhead can be harsh, and potentially at high pressure. Leakage of fluids from out of the wellhead, such as through a hole formed for an ESP cable is generally undesirable. Further, spliced connections through the wellhead can represent failure points for electrical conductivity to the ESP. Accordingly, wellhead penetrators have been developed to mitigate the potential for such leakage.

SUMMARY

Embodiments of the disclosure include a wellhead penetrator including a mandrel having first and second ends, a lock nut that is adjustably connected to the second end of the mandrel, a tapered bowl positioned within the lock nut, the mandrel, or both, a cable lock assembly at least partially received into the mandrel and the lock nut. Moving the lock nut in an axial direction relative to the mandrel causes the cable lock assembly to grip a cable received therethrough. The penetrator also includes a sealing element positioned at least partially within the mandrel and spaced apart from the tapered bowl, and a backup member positioned adjacent to the sealing element and at least partially within the mandrel. A lower end of the backup member presses against the sealing element so as to prevent misalignment of the sealing element with respect to the mandrel, and the mandrel, the lock nut, the sealing element, and the backup member are configured to receive the cable therethrough.

Embodiments of the disclosure also include a method that includes receiving a lock nut on a cable, receiving a sealing element on the cable, axially spaced apart from the lock nut, receiving a backup member into engagement with the sealing element, sliding a mandrel over the backup member and the sealing element, such that the sealing element forms a seal within the mandrel and the backup member is prevented from sliding through the mandrel, and connecting the mandrel to the lock nut. Connecting includes rotating the lock nut relative to the mandrel, the lock nut and the mandrel each including threads that are engaged and advanced by rotating the lock nut relative to the mandrel, and driving one or more gripping members of a cable lock assembly into a tapered bowl of the cable lock assembly, such that the one or more gripping members apply a radial gripping force onto the cable, to prevent dislocation of the cable relative to the mandrel and the lock nut.

Embodiments of the disclosure also include a wellhead penetrator including a mandrel having a lower end that is threaded, a lock nut having an upper end that is threaded into engagement with the lower end of the mandrel. A cable is received through the mandrel and the lock nut, the cable having an armored section and an unarmored section. The penetrator also includes a cable lock assembly positioned in the lock nut. The cable lock assembly is configured to grip the armored section of the cable in response to the lock nut being rotated relative to the mandrel. The penetrator further includes a sealing element positioned at least partially within the mandrel and spaced apart from the sealing element. The sealing element receives individual wires of the unarmored section of the cable therethrough. The penetrator also includes a backup member adjacent to the sealing element and at least partially within the mandrel and configured to receive the individual wires of the unarmored section of the cable therethrough. A lower end of the backup member presses against the sealing element so as to prevent misalignment of the sealing element with respect to the mandrel, and wherein the backup member is retained by a shoulder formed in the mandrel and is configured to prevent the sealing element from being misaligned with respect to the mandrel.

BRIEF DESCRIPTION OF THE DRAWINGS

The present disclosure may best be understood by referring to the following description and accompanying drawings that are used to illustrate some embodiments. In the drawings.

DETAILED DESCRIPTION

Figure 1A:
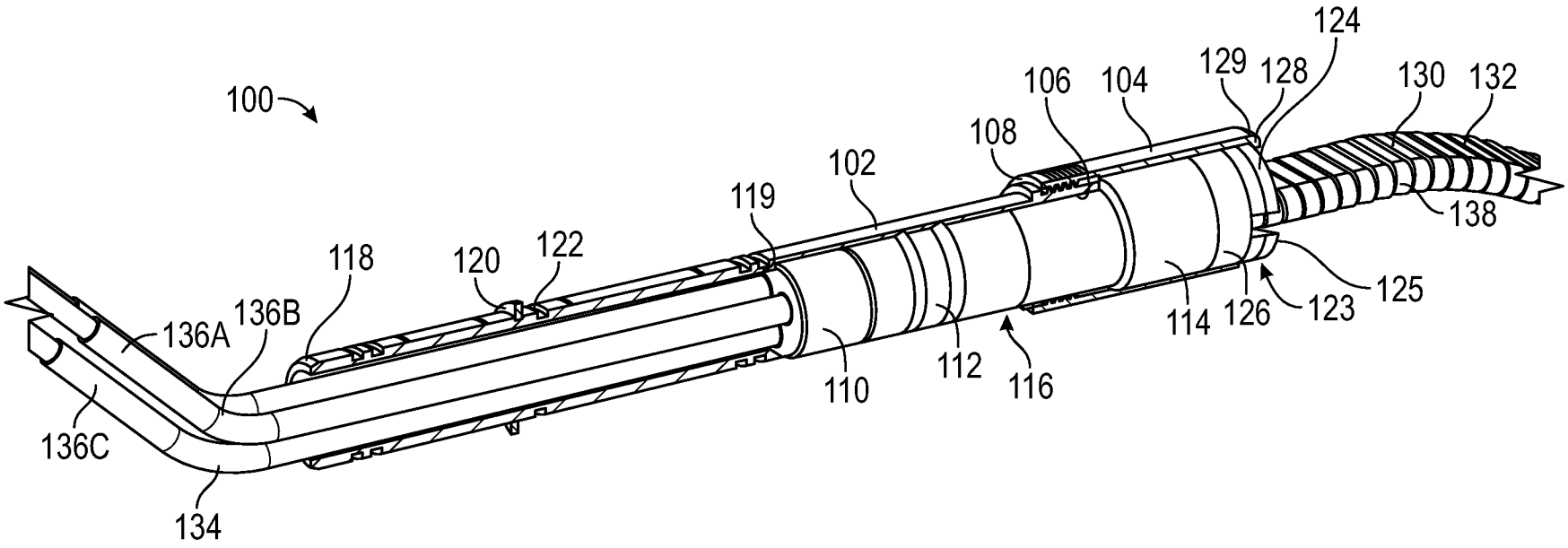
FIG. 1A illustrates a perspective sectional view of a wellhead penetrator, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1A illustrates a perspective view of a wellhead penetrator 100 configured to extend into a wellhead, providing a sealed path for electrically-conductive cables, wires, leads, etc., through the wellhead, according to an embodiment. The wellhead penetrator 100 may be configured to provide electrical conductivity through the wellhead from a power source at the surface to a pump or another electronic device within the well.

In an embodiment, the wellhead penetrator 100 may include an outer mandrel 102 and a lock nut 104, with the outer mandrel 102 being threaded into engagement with the lock nut 104. For example, the mandrel 102 may have an end 106 that is externally (male) threaded, while the lock nut 104 may have an end 108 that is internally (female) threaded. Accordingly, rotation of the mandrel 102 and the lock nut 104 relative to one another (by rotating either or both relative to a stationary reference frame) may advance the lock nut 104 onto the mandrel 102. In other embodiments, the lock nut 104 may instead be received into the mandrel 102. The mandrel 102 and the lock nut 104 may thus both be cylindrical, or at least partially cylindrical, and generally define collinear central longitudinal axes therethrough. As the term is used herein, "axial" means in a direction parallel to the central longitudinal axis of the cylindrical mandrel 102 and/or lock nut 104, while "radial" refers to a direction perpendicular to the axial direction (i.e., perpendicular to the central longitudinal axes).

The mandrel 102 and the lock nut 104 may be hollow, and thus the combination thereof (when connected together) may house several components therein. For example, a backup member 110 and a sealing element 112 may be housed within the mandrel 102 and may be axially-adjacent to one another, e.g., in axial engagement with one another and/or connected together. The sealing element 112 may be made from a resilient material suitable for forming a seal within the mandrel 102, such as, for example, rubber or another elastomeric or polymeric material. The backup member 110 may be made from any suitable material (e.g., metal, plastic, ceramic, etc.). An encapsulant collar 114 may be housed at least partially in the mandrel 102 and at least partially within the lock nut 104. The encapsulant collar 114 may also be metallic (or another suitable material), and may contain encapsulant therein, as will be described in greater detail below. Further, the encapsulant collar 114 may be separated axially apart from the sealing element 112 by a gap 116, which may be filled with encapsulant, in an embodiment, and defined between the encapsulant collar 114 and the sealing element 112.

On the opposite axial side of the backup member 110, the mandrel 102 may extend for a distance to an upper end 118. A shoulder 119 may retain the back-up member 110 in place within the mandrel 102, and an unsealed section of the mandrel 102 may extend from the shoulder 119 to the upper end 118. A retaining member 120 may be connected to the exterior of the mandrel 102 in alignment with this unsealed section of the mandrel 102. The retaining member 120 may be configured to maintain a position of the wellhead penetrator 100 within the wellhead, as will be described in greater detail below. In some embodiments, the retaining member 120 may be or include a snap ring, which may be received into a recess 122 formed in the exterior of the mandrel 102, but in other embodiments, other structures, devices, geometries of the mandrel 102, etc., may be employed in lieu of or in addition to such a snap ring to provide the retaining member 120.

The wellhead penetrator 100 may also include a cable lock assembly 123. For example, the cable lock assembly 123 may include one or more gripping members (two shown: 124, 125) and a conical bowl 126 into which the one or more gripping members 124, 125 are at least partially received. A lip 128 formed on a lower end 129 of the lock nut 104 may engage the one or more gripping members 124, 125, and thus advancing the lock nut 104 toward the mandrel 102 may drive the gripping members 124, 125 farther into the conical bowl 126, thereby pressing the gripping members 124, 125 radially inward, as will be described in greater detail below.

A cable 130 may extend through the wellhead penetrator 100. For example, the cable 130 may include an armored section 132 and an unarmored section 134. Further, the cable 130 may include two or more (e.g., three) electrically-conductive wires 136A, 136B, 136C. In the armored section 132, the wires 136A-C may extend within an outer protective armor 138, and in the unarmored section 134, the wires 136A-C may extend out of the protective armor 138. In an embodiment, the armored section 132 of the cable 130 may extend from below the wellhead penetrator 100 up through a lower end 129 of the lock nut 104, which may provide an opening, slot, etc. configured to permit passage of the armored section 132 of the cable 130 therethrough. The unarmored section 134 may extend within the lock nut 104 and the mandrel 102, such that the separate wires 136A-C may extend through separate holes formed in the sealing element 112 and the backup member 110, e.g., one for each wire 136A-C. The cable 130 may be flat or round in exterior shape in the armored section 132.

Figure 1B:
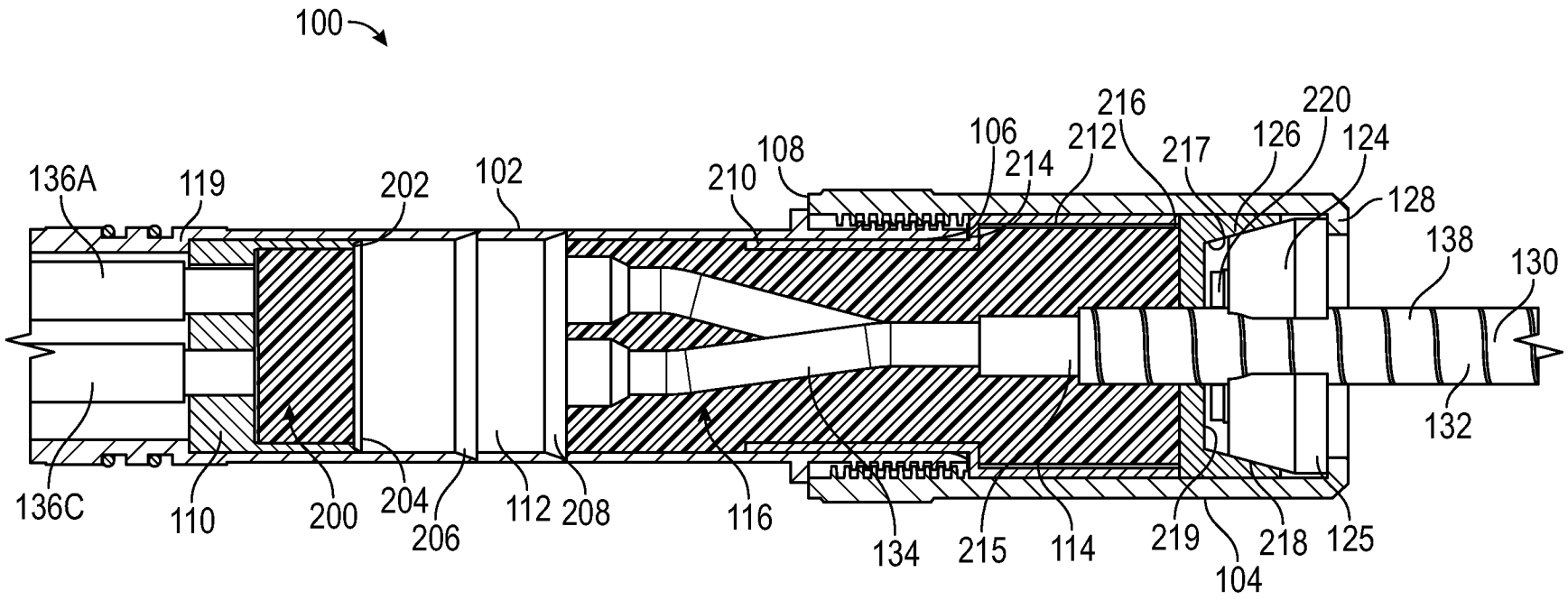
FIG. 1B illustrates an enlarged, side, sectional view of a portion of the wellhead penetrator, according to an embodiment.

FIG. 1B illustrates a side, cross-sectional view of a portion of the wellhead penetrator 100, specifically, the lower portion of the mandrel 102 and the lock nut 104, and those components housed therein, according to an embodiment. As noted above, the backup member 110 and the sealing element 112 may be housed within the mandrel 102. The wires 136A-C (the wire 136B is not visible in this cross-section) extend through separate holes formed in the backup member 110 and sealing element 112.

As shown, the interior of the backup member 110 may define a cavity 200. The cavity 200 may be filled with encapsulant (e.g., epoxy or any other type of sealant material or bonding material). Further, a lower annular end 202 of the backup member 110 may press against the outer edge of an upper surface 204 of the sealing element 112. Further, the sealing element 112 may include two skirts 206, 208, which are separated axially apart from one another. The skirts 206, 208 may engage the inner diameter surface of the mandrel 102, so as to prevent fluid from leaking past the sealing element 112. Further, the annular end 202 of the backup member 110 engaging the upper surface 204 of the sealing element 112 prevents misalignment of the sealing element 112 within the mandrel 102, e.g., maintains a coaxial orientation of the sealing element 112 with respect to the mandrel 102. This may ensure that the skirts 206, 208 uniformly engage the mandrel 102, thereby promoting the formation of an effective seal between the sealing element 112 and the inner diameter surface of the mandrel 102. The encapsulant in the cavity 200 may serve to prevent leakage of any fluid along the wires 136A-C extending through the sealing element 112.

Continuing downward from the sealing element 112, the encapsulant collar 114 is shown located partially within the mandrel 102 and partially within the lock nut 104. In particular, the encapsulant collar 114 may include two sections 210, 212, with the section 212 being radially larger than the section 210. A shoulder 214 is thus formed between the two sections 210, 212. The shoulder 214 may engage the lower end 106 of the mandrel 102, so as to locate the encapsulant collar 114 relative to the mandrel 102. Further, as noted above, the encapsulant collar 114 may be at least partially (e.g., substantially or entirely) filled with encapsulant. The encapsulant may serve to prevent fluid leakage from the well below the wellhead penetrator 100 along the wires 136A-C, and also to protect the wires 136A-C from swelling due to contact with any well fluid that may reach the interior of the penetrator 100. It will thus be noted that there is encapsulant on both axial sides of the sealing element 112, thus preventing fluid passage through the sealing element 112 and maintaining the position and shape of the sealing element 112. In some embodiments, the cable 130 may include a lead layer 215, which may extend within the outer armor 138, and into the unarmored section 134. The lead layer 215 is configured to prevent the well fluid from damaging the wires 136A-C in the well.

The bowl 126 may abut an upper end 216 of the encapsulant collar 114, thereby containing the encapsulant within the encapsulant collar 114. As shown, the interior of the bowl 126 may have a tapered (conical) surface 217, which may be tapered in reverse orientation to a tapered outer surface 218 of the generally wedge-shaped gripping members 124, 125. The bowl 126 may also have an axial-facing bottom surface 219.

As the lock nut 104 is advanced toward the mandrel 102 (e.g., by rotating the lock nut 104 relative to the mandrel 102), the lip 128 may press the gripping members 124, 125 into the bowl 126, toward the bottom surface 219, and the tapered engagement between the surfaces 217, 218 may press the gripping members 124, 125 radially inward, into engagement with the armor 138 of the cable 130. The gripping members 124, 125 may include an anti-crush element 220 thereon, which may constrain how far the gripping members 124, 125 may be moved into the bowl 126. As such, the anti-crush element 220 may prevent the gripping members 124, 125 from advancing so far axially into the bowl 126 that they gripping member 124, 125 press radially into the cable 130 with sufficient force to damage the cable 130. However, the anti-crush element 220 may permit the gripping members 124, 125 to tightly engage the cable 130 and prevent the cable 130 from being removed from the wellhead penetrator 100 under normal operating conditions. In an embodiment, the anti-crush element 220 may be a beveled end of the gripping members 124, 125 themselves, or may be another type of extension or a separate piece configured to contact an axially-facing, bottom of the bowl 126 and thereby prevent further axial advancement of the gripping members 124, 125.

Additionally, pressing the gripping members 124, 125 axially by advancing the lock nut 104 may also serve to apply an axial force on the encapsulant that is within the encapsulant collar 114, and within the gap 116, which may cause the encapsulant to fill any empty spaces or voids, and thereby promote an effective seal. Further, such pressure may be transmitted via the encapsulant to the sealing element 112, which in turn presses the encapsulant within the cavity 200, likewise causing the encapsulant to fill any gaps and thereby promote the formation of an effective seal.

Figure 2:
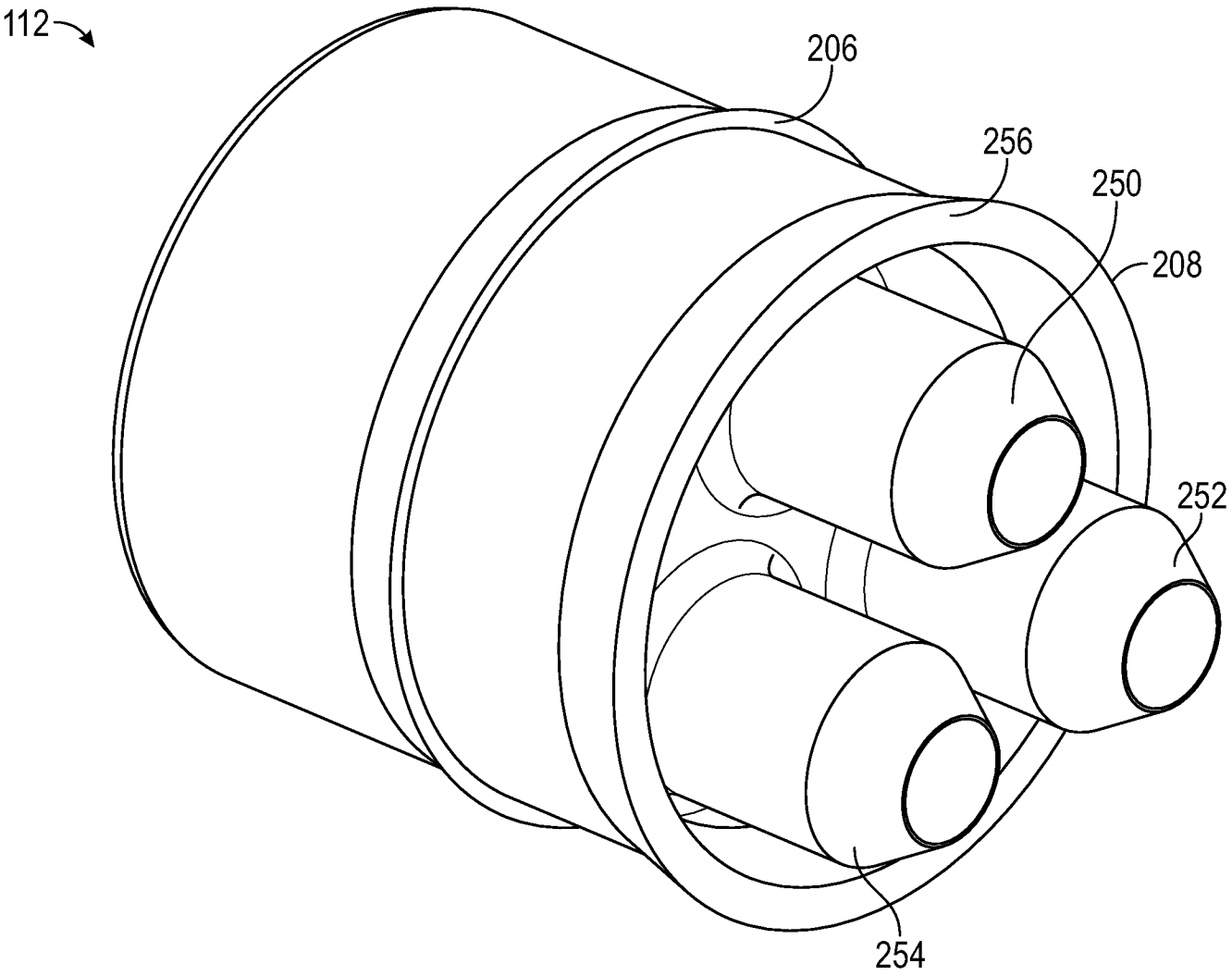
FIG. 2 illustrates a perspective view of a sealing element, according to an embodiment.

Referring now additionally to FIG. 2, there is shown a perspective view of the sealing element 112. As shown, the sealing element 112 may include sleeves or "nipples" 250, 252, 254 extending from a beveled lower surface 256 thereof. The wires 136A-C may extend through the individual nipples 250, 252, 254, such that the nipples 250-254 extend along the insulation on the wires 136A-C to promote formation of a seal therewith. Further, the sealing element 112 is self-energized, because at least the skirts 206, 208 thereof are slightly larger in diameter than the inside of the mandrel 102, while openings in the nipples 250-254 are slightly smaller than the wires 136A-C.

Figure 3:
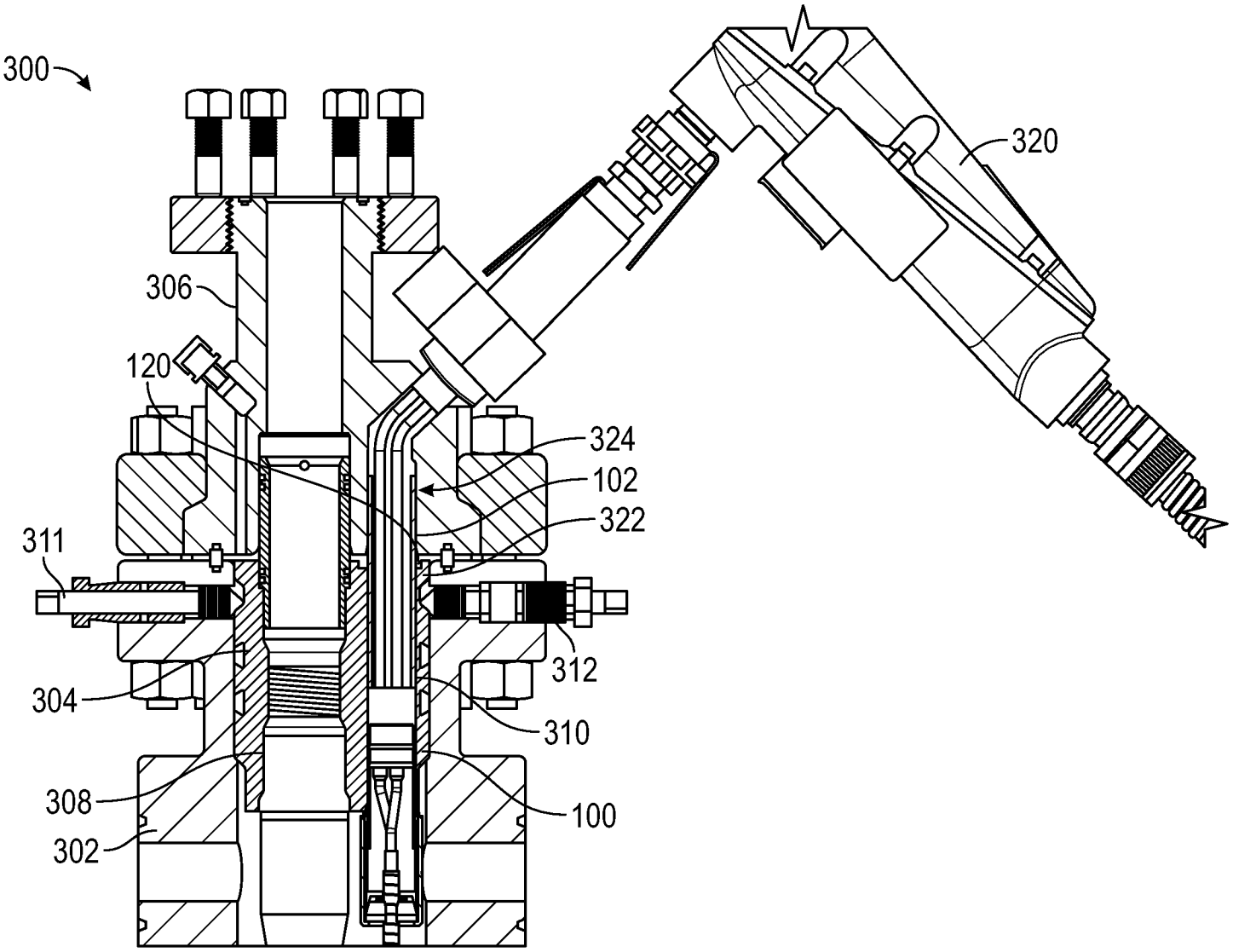
FIG. 3 illustrates a side, sectional view of a wellhead assembly, according to an embodiment.

FIG. 3 illustrates a side, sectional view of a wellhead assembly 300, according to an embodiment. As shown, the wellhead assembly 300 generally includes a wellhead 302, in which a tubing hanger 304 is received. A wellhead adapter 306 may be received onto the top of the wellhead 302 and connected thereto so as to seal the wellhead 302. The tubing hanger 304 may include a first bore 308 configured to connect to and support a production tubing that extends into the wellbore below. The tubing hanger 304 may also include a second bore 310 through which the penetrator 100 extends. The tubing hanger 304 may be secured in place by interaction with one or more shoulders formed in the wellhead 302 and/or one or more set screws (two shown: 311, 312) that extend through the wellhead 302 and engage the tubing hanger 304.

The wellhead assembly 300 may also include a power connection 320. The power connection 320 may be configured to connect to the cable 130 so as to provide power to an electronic submersible pump (ESP) disposed within the wellbore, below the wellhead 302. The power connection 320 may be mounted to the wellhead adapter 306, so as to generally prevent communication between the ambient environment and the interior of the wellhead adapter 306 and the penetrator 100 therein.

As can be seen, the penetrator 100 includes the various components discussed above, which may provide for electrical conductivity through the wellhead 302, while preventing leakage of the wellbore fluids up from within the well. Additionally, the retainer member 120 may be received onto a shoulder 322 formed at the top of the tubing hanger 304, so as to position and support the penetrator 100 with respect to the tubing hanger 304. Further, the mandrel 102 may extend along most or all of the second bore 310 formed vertically in the tubing hanger 304 as well as into and partially through a bore 324 formed in the wellhead adapter 306. Accordingly, the geometry for the second bore 310 may be a relatively simple, straight-through geometry with the shoulder 322 at the top. Such a simple geometry may, for example, enable retrofitting of existing tubing hangers 304 for use with the present penetrator 100 by simply milling out the second bore 308 to a straight profile, with a chamfered shoulder at the top to receive the retainer 120.

Figure 4A:
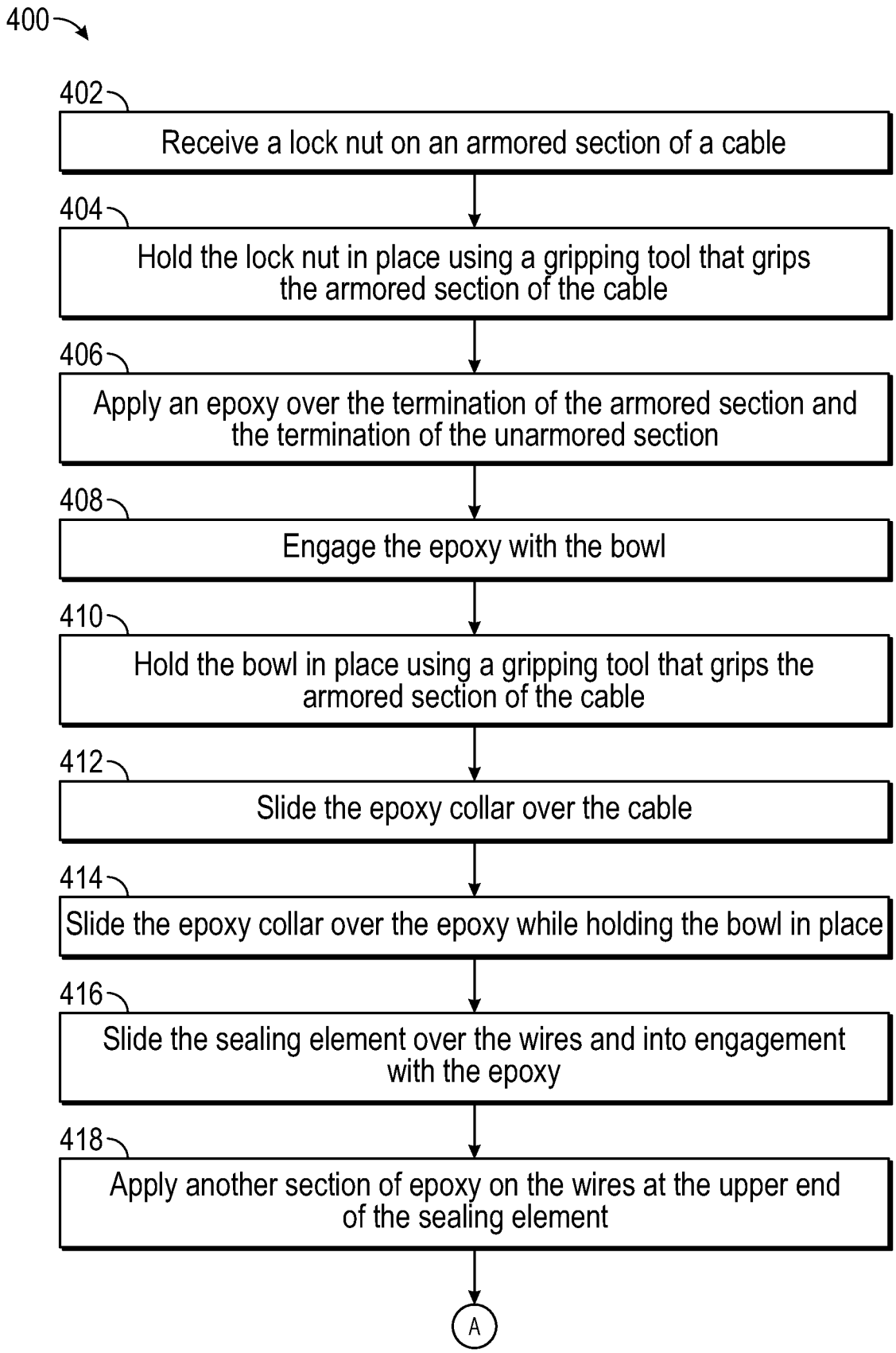
FIGS. 4A and 4B illustrate a flowchart of a method for assembling a wellhead penetrator and installing the wellhead penetrator in a wellhead, according to an embodiment.
Figure 4B:
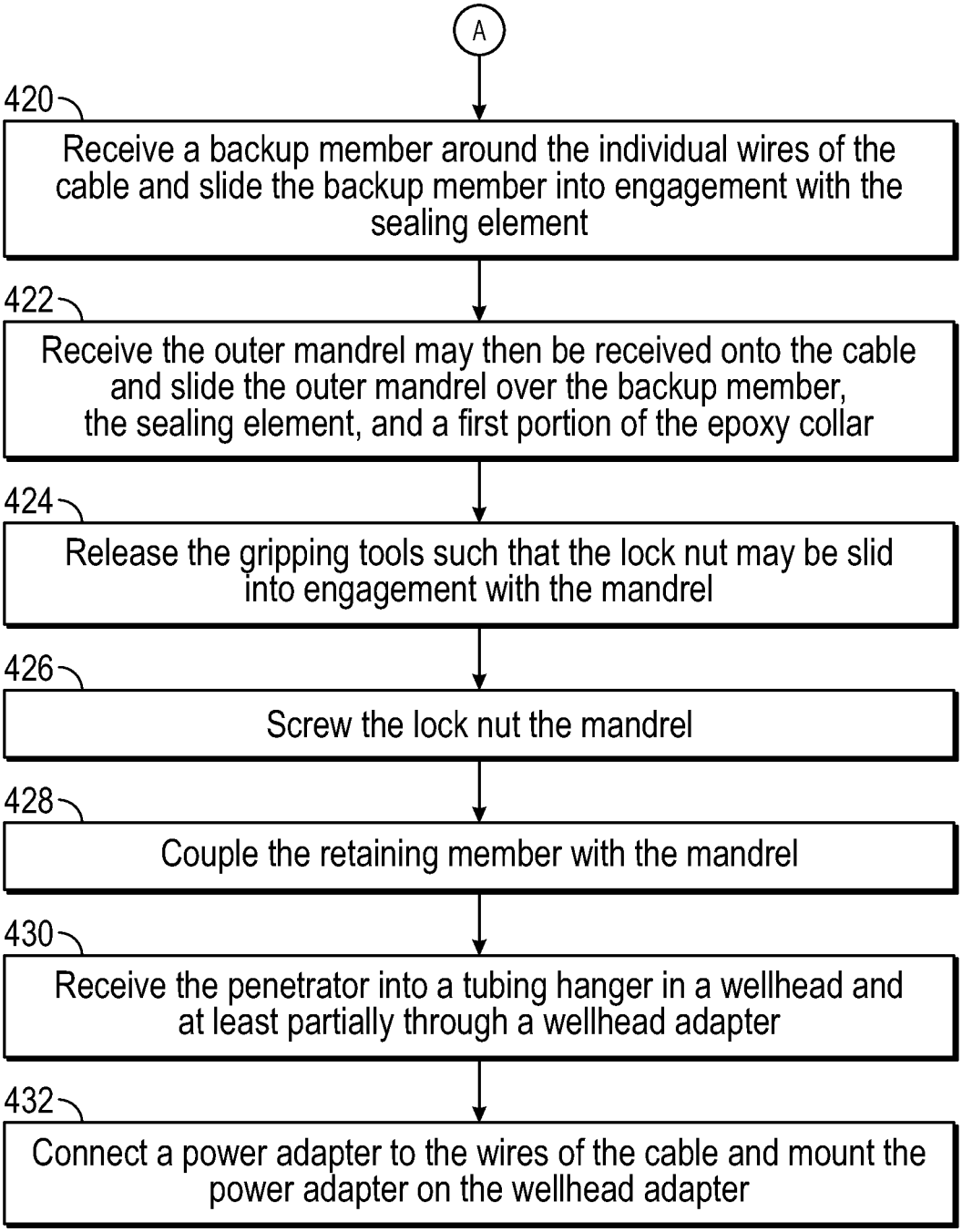

FIGS. 4A and 4B illustrate a flowchart of a method 400 for assembling a wellhead penetrator on a cable, and securing the wellhead penetrator in a wellhead assembly, according to an embodiment. Execution of the method 400 may result in the wellhead penetrator 100 discussed above being secured to the cable 130, which may then be positioned in a wellhead assembly 300 as shown in and discussed above with respect to FIG. 3. Accordingly, the method 400 will be discussed with additional reference to FIGS. 5-12, which provide views of the various stages of the wellhead penetrator 100 being connected to the cable 130. In at least some embodiments, however, the method 400 may be employed to form other types of structures, and thus the method 400 should not be limited to any particular structures unless otherwise stated herein. Further, it will be appreciated that the various steps of the method 400 may be combined, separated, performed in parallel, and/or performed in a different order than depicted herein without departing from the scope of the present disclosure.

Figure 5:
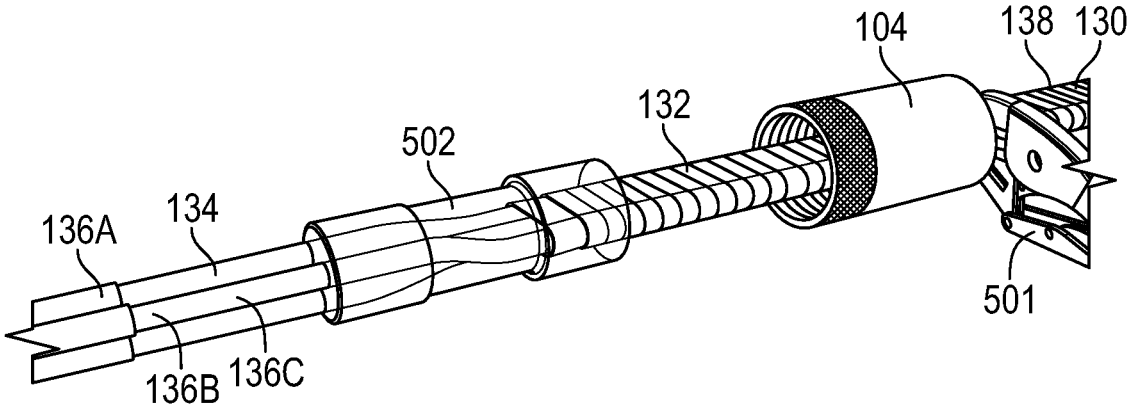
FIGS. 5-12 illustrate the wellhead penetrator being assembled at different stages of the method of FIGS. 4A and 4B, according to an embodiment.

The method 400 may begin by receiving the lock nut 104, e.g., with the clamping assembly 123 therein, on the cable 130, as at 402. The cable 130 may be partially stripped to expose wires 136A-C extending from the outer armor 138, forming the unarmored section 134 and the armored section 132, as discussed above. The lock nut 104 may be slid onto the armored section 132. This is shown in FIG. 5. The lock nut 104 may be held in place by a gripping tool, as at 404, such as vice grips 501, which are configured to grip the armored section 132 of the cable 130. The lock nut 104 may thus be slid up against the vice grips 501, which prevent further sliding of the lock nut 104 along the cable 130.

As also depicted in FIG. 5, in some embodiments, the method 400 may include applying an encapsulant 502 (e.g., a "first" encapsulant) over the termination of the armored section 132 and the termination of the unarmored section 132, as at 406. As such, the encapsulant 502 is applied to both the armored section 132 and the separate wires 136A-C of the unarmored section 134. The encapsulant 502 is illustrated as having a precise form with three cylindrical sections; however, the encapsulant 502 may generally be formed as an amorphous "blob" to begin, and is pressed into conformity with the inner profile of the penetrator 100 by interaction with the other components, as the other components are installed as described herein and press the encapsulant 502 into a desired shape. In other embodiments, the encapsulants may be omitted, as will be described in greater detail below.

Figure 6:
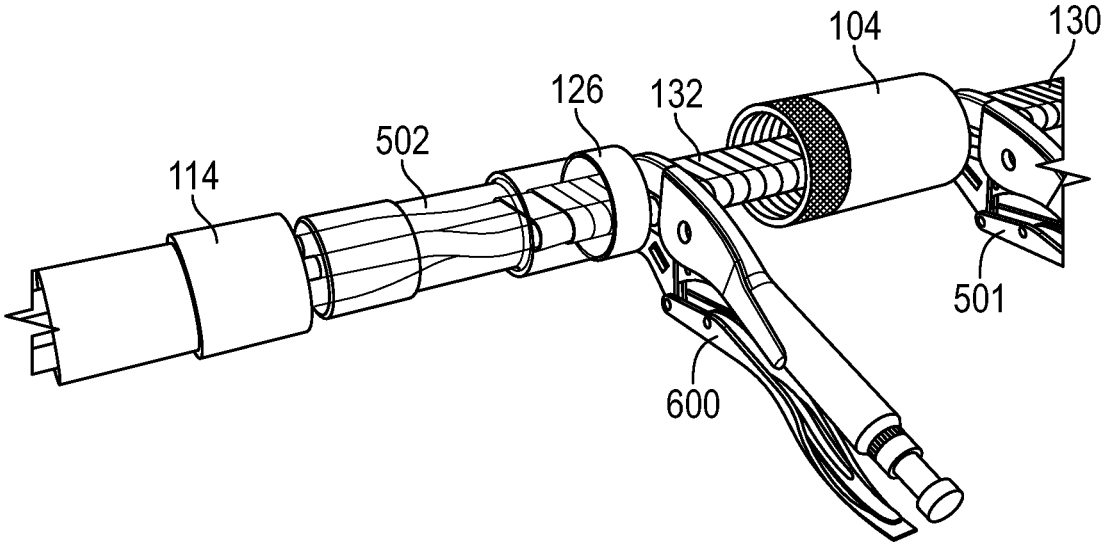

The method 400 may then proceed to engaging the encapsulant 502 with the bowl 126, as at 408. This is illustrated in FIG. 6. The bowl 126 may initially be received onto the cable 130 along with the lock nut 104, and thus may be slid out of the lock nut 104 and pressed against the encapsulant 502. A second pair of vice grips 600, or any other gripping/locating tool to hold the bowl 126 in place, may engage the cable 130 in the armored section 132, thereby holding the encapsulant 502 in place, as at 410. As also illustrated in FIG. 6, the method 400 may then include sliding the encapsulant collar 114 over the cable 130, e.g., over the unarmored section 134 and toward the armored section 132 and toward the encapsulant 502, as at 412.

Figure 7:
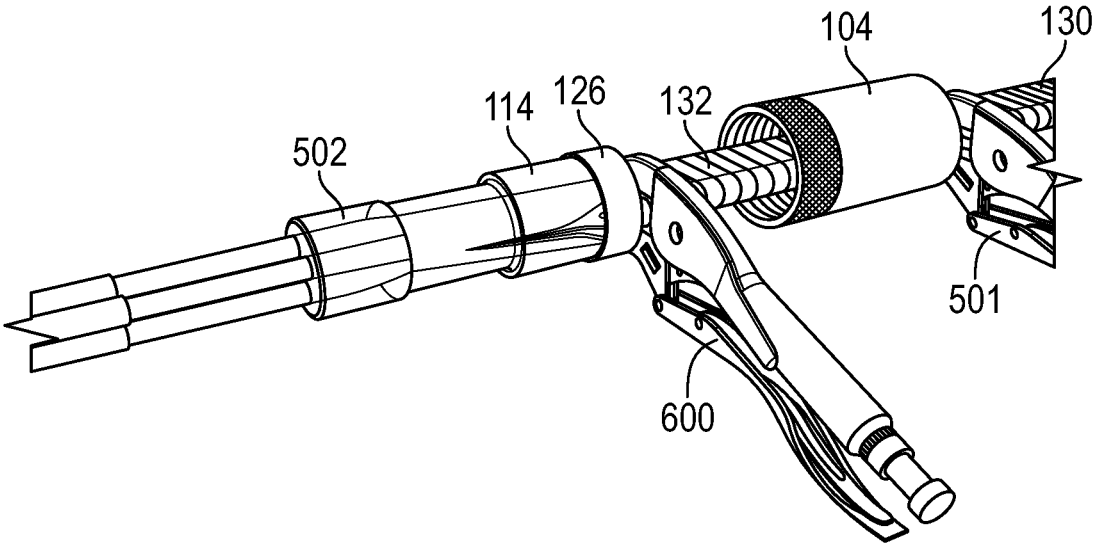

The method 400 may then proceed to sliding the encapsulant collar 114 over the encapsulant 502, while holding the bowl 126 in place, as at 414. This is illustrated in FIG. 7. As shown, the encapsulant 502 may extend past the upper (left) end of the collar 114.

Figure 8:
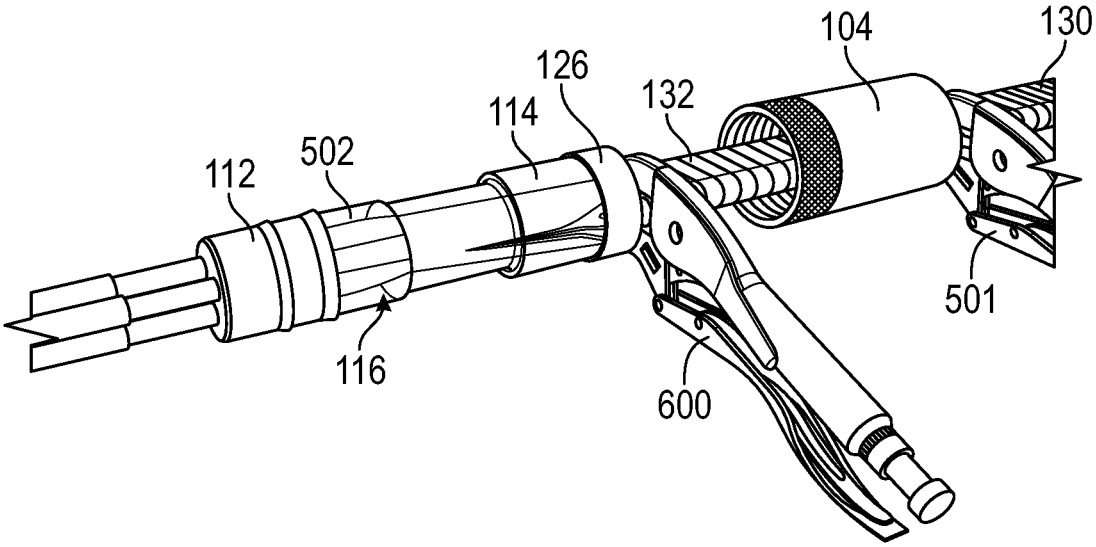
Figure 9:
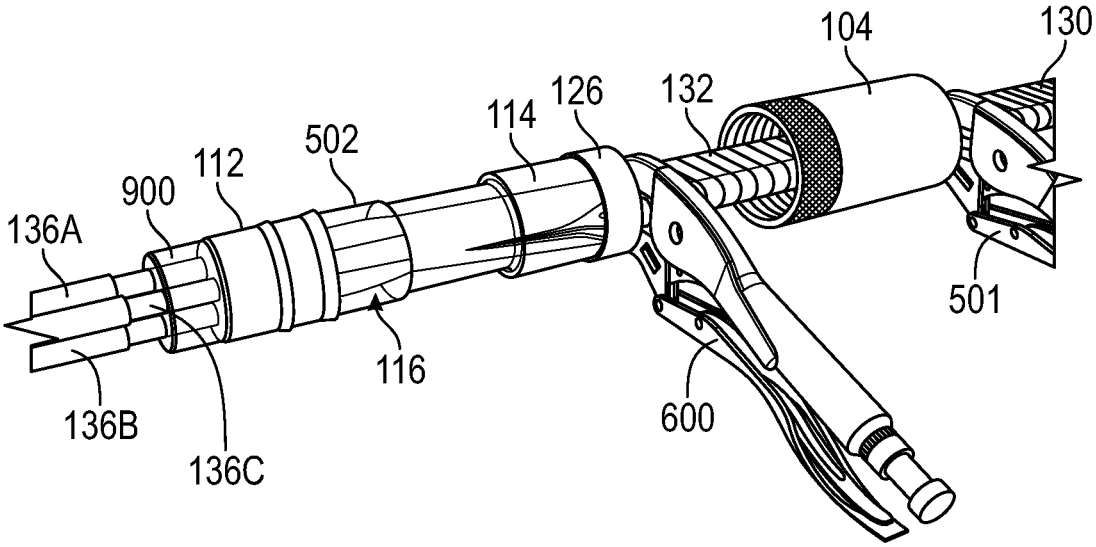

Next, the sealing element 112 may be slid over the wires 136A-C and into engagement with the encapsulant 502, as at 416. This is illustrated in FIG. 8. The portion of the encapsulant 502 that extends up past the end of the encapsulant collar 114 may remain in place, and may be configured to fill the gap 116 between the encapsulant collar 114 and the sealing element 112, as mentioned above with respect to FIGS. 1 and 2. Further, as at 418 and as shown in FIG. 9, another section of encapsulant ("second" encapsulant) 900 may be formed on the upper end of the sealing element 112, and again may start as an amorphous blob. The first and second encapsulant 502, 900 may be formed from the same material or different materials.

Figure 10:
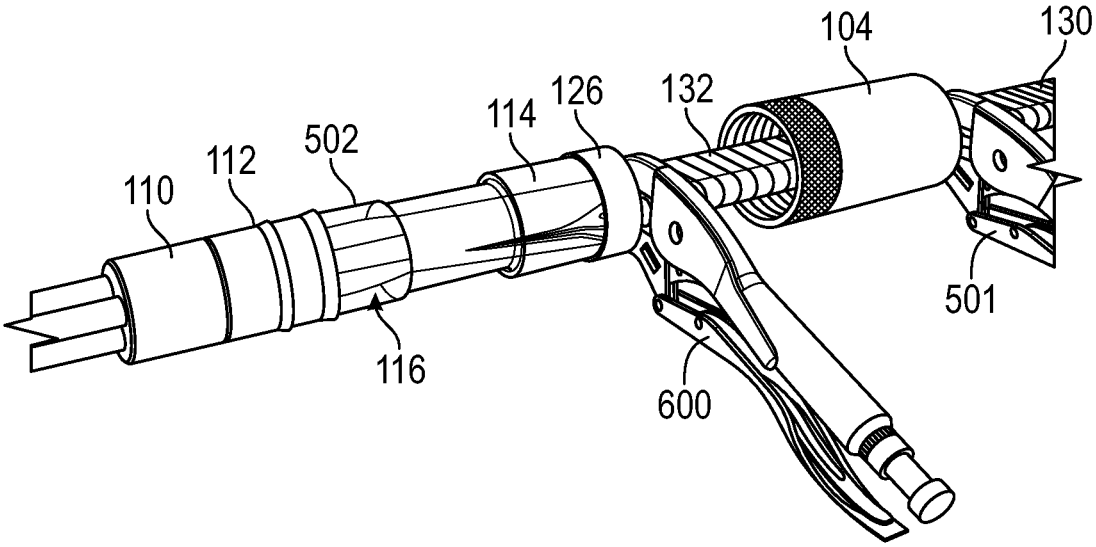

The backup member 110 may then be received around the cable 130, e.g., with a separate passage for each of the wires 136A-C individually, and slid into engagement with the sealing element 112, as at 420. As illustrated in FIG. 10, the backup member 110 may be received around the encapsulant 900, which may reside in the cavity 200 (FIG. 1B) formed therein. Any excess encapsulant 900 may be squeezed out between the backup member 110 and the sealing element 112 during installation of the backup member 110.

Figure 11:
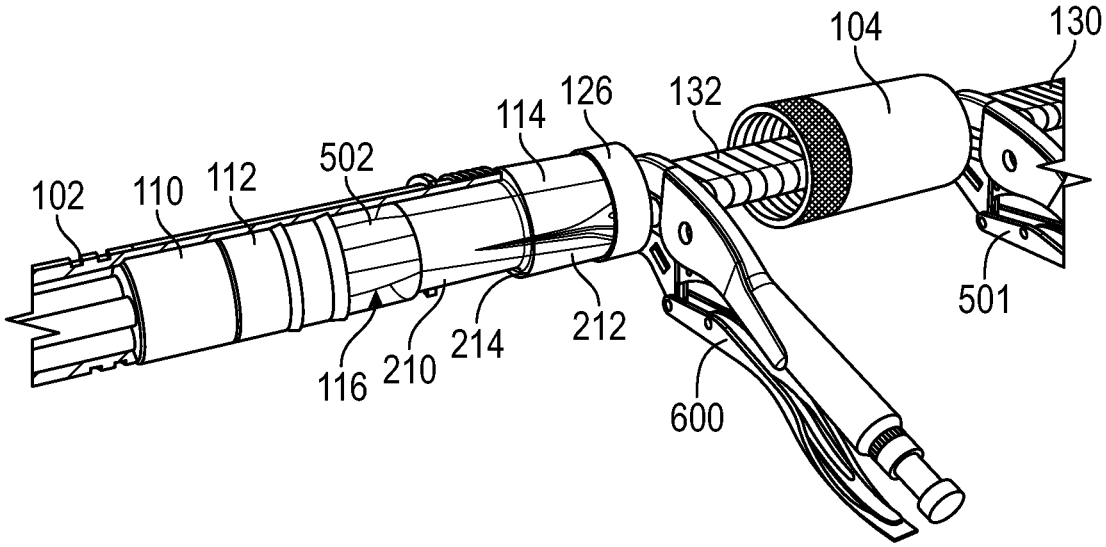
Figure 12:
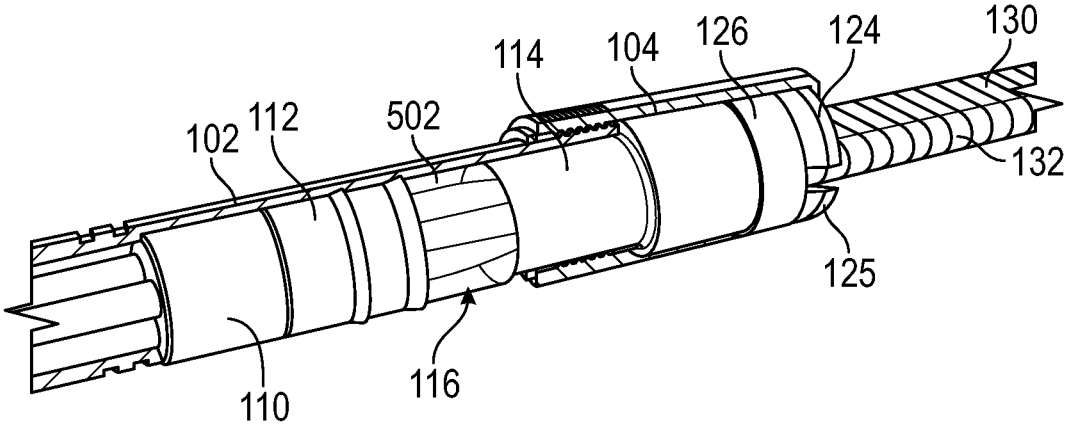

The outer mandrel 102 (shown in half-section) may then be received onto the cable 130 and slid over the backup member 110, the sealing element 112, the encapsulant 502 filling the gap 116, and the first section 210 of the encapsulant collar 114, as at 422. The mandrel 102 may be slid on until it is stopped by engagement with the shoulder 214 of the encapsulant collar 114. This stage is illustrated in FIG. 11.

The gripping tools 501, 506 may then be released, such that the lock nut 104 may be slid into engagement with the mandrel 103, as at 424. The lock nut 104 may then be screwed onto (or otherwise moved axially relative to) the mandrel 102, as at 426. This may proceed by holding the lock nut 104 stationary and rotating the mandrel 102, or by holding the mandrel 102 stationary and rotating the lock nut 104, or by rotating both (e.g., in opposite directions). As described above, screwing the lock nut 104 onto the mandrel 102 causes the lock nut 104 to press the gripping members 124, 125 axially into the bowl 126, and thus radially inwards into engagement with the cable 130, thereby holding the penetrator 100 in position relative to the cable 130. The lock nut 104 may be screwed onto the mandrel 102 until fully threaded thereon, or until, e.g., the encapsulant 504 prevents further advancement of the lock nut 104.

As shown in FIG. 1, the retaining member 120 may be coupled with the mandrel 102, as at 428. As shown in FIG. 3, the penetrator 100 may then be received into the second bore 310 of the tubing hanger 304 and at least partially through the wellhead adapter 306, as at 430. The power connector 320 may then be connected to the wires 136A-C, thereby forming an electrical connection with a submersible pump or another electric device below the wellhead 302. Finally, the power connector 320 may be mounted on the wellhead adapter 306, as at 432.

Figure 13:
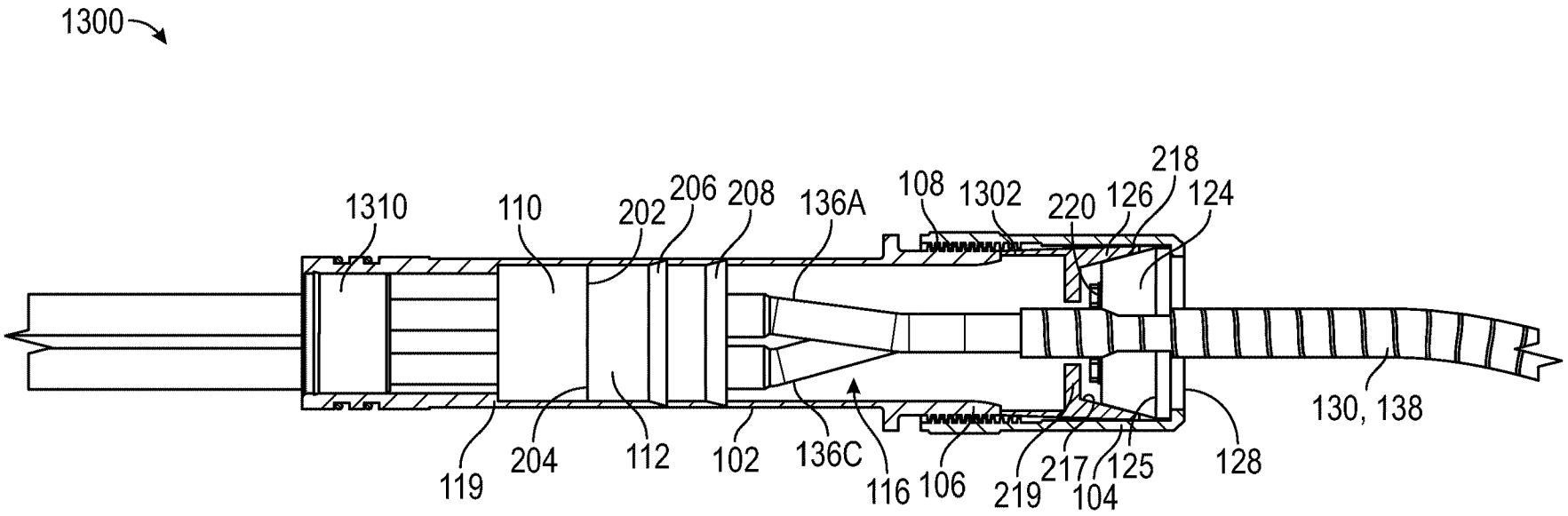
FIG. 13 illustrates a side, cross-sectional view of another wellhead penetrator, according to an embodiment.

In some embodiments, the encapsulant (e.g., epoxy) may be omitted. FIG. 13 illustrates such an embodiment of a wellhead penetrator 1300. The wellhead penetrator 1300 may be generally similar to the wellhead penetrator 100, as discussed above, and thus similar components are given similar reference numbers for ease of understanding and to avoid duplicative descriptions thereof. For example, the wellhead penetrator 1300 may be configured to extend into a wellhead, providing a sealed path for electrically-conductive cables, wires, leads, etc., through the wellhead, according to an embodiment. The wellhead penetrator 1300 may be configured to provide electrical conductivity through the wellhead from a power source at the surface to a pump or another electronic device within the well.

In an embodiment, the wellhead penetrator 1300 may include the outer mandrel 102 and the lock nut 104, with the outer mandrel 102 being threaded into engagement with the lock nut 104. For example, the mandrel 102 may have the end 106 that is externally (male) threaded, while the lock nut 104 may have the end 108 that is internally (female) threaded. Accordingly, rotation of the mandrel 102 and the lock nut 104 relative to one another (by rotating either or both relative to a stationary reference frame) may advance the lock nut 104 onto the mandrel 102. In other embodiments, the lock nut 104 may instead be received into the mandrel 102. The mandrel 102 and the lock nut 104 may thus both be cylindrical, or at least partially cylindrical, and generally define collinear central longitudinal axes therethrough. As the term is used herein, "axial" means in a direction parallel to the central longitudinal axis of the cylindrical mandrel 102 and/or lock nut 104, while "radial" refers to a direction perpendicular to the axial direction (i.e., perpendicular to the central longitudinal axes).

The mandrel 102 and the lock nut 104 may be hollow, and thus the combination thereof (when connected together) may house several components therein. For example, the backup member 110 and the sealing element 112 may be housed within the mandrel 102 and may be axially-adjacent to one another, e.g., in axial engagement with one another and/or connected together. The sealing element 112 may be made from a resilient material suitable for forming a seal within the mandrel 102, such as, for example, rubber or another elastomeric or polymeric material. The backup member 110 may be made from any suitable material (e.g., metal, plastic, ceramic, etc.).

On the opposite axial side of the backup member 110, the mandrel 102 may extend for a distance to the upper end. The shoulder 119 may retain the back-up member 110 in place within the mandrel 102, and an unsealed section of the mandrel 102 may extend from the shoulder 119 to the upper end 118. A retaining member may be connected to the exterior of the mandrel 102 in alignment with this unsealed section of the mandrel 102. The retaining member may be configured to maintain a position of the wellhead penetrator 100 within the wellhead. In some embodiments, the retaining member may be or include a snap ring, which may be received into a recess formed in the exterior of the mandrel 102, but in other embodiments, other structures, devices, geometries of the mandrel 102, etc., may be employed in lieu of or in addition to such a snap ring to provide the retaining member.

The wellhead penetrator 100 may also include a cable lock assembly, as shown. For example, the cable lock assembly may include the gripping members 124, 125 and the conical bowl 126 into which the gripping members 124, 125 are at least partially received. The lip 128 formed on a lower end of the lock nut 104 may engage the gripping members 124, 125, and thus advancing the lock nut 104 toward the mandrel 102 may drive the gripping members 124, 125 farther into the conical bowl 126, thereby pressing the gripping members 124, 125 radially inward, as will be described in greater detail below.

The cable 130 may extend through the wellhead penetrator 100. For example, the cable 130 may include an armored section and an unarmored section. Further, the cable 130 may include two or more (e.g., three) electrically-conductive wires (two are visible: 136A, 136C). In the armored section, the wires 136A-B may extend within an outer protective armor 138, and in the unarmored section, the wires 136A-C may extend out of the protective armor 138. In an embodiment, the armored section of the cable 130 may extend from below the wellhead penetrator 100 up through the lower end of the lock nut 104, which may provide an opening, slot, etc. configured to permit passage of the armored section of the cable 130 therethrough. The unarmored section may extend within the lock nut 104 and the mandrel 102, such that the separate wires 136A-C may extend through separate holes formed in the sealing element 112 and the backup member 110, e.g., one for each wire 136A-C. The cable 130 may be flat or round in exterior shape in the armored section 132.

As noted above, the backup member 110 and the sealing element 112 may be housed within the mandrel 102. The wires 136A,C (the wire 136B is not visible in this cross-section) extend through separate holes formed in the backup member 110 and sealing element 112. As shown, the interior of the backup member 110 may omit the cavity discussed above with reference to FIG. 1B. The backup member 110 may also not include the cavity 200 discussed above for retaining encapsulant between the backup member 110 and the sealing element 112. Thus, the sealing element 112 may not engage encapsulant on either axial side. Rather, the backup member 110 may directly engage the sealing element 112, such that the two interface along all but the conduit areas through which the cables 136A-C extend. In some embodiments, a dovetail connection may be formed and bonding material may be interposed and used to adhere the sealing element 112 and the backup member 110 together.

Further, the sealing element 112 may include two skirts 206, 208, which are separated axially apart from one another. The skirts 206, 208 may engage the inner diameter surface of the mandrel 102, so as to prevent fluid from leaking past the sealing element 112. Further, the annular end 202 of the backup member 110 engaging the upper surface 204 of the sealing element 112 prevents misalignment of the sealing element 112 within the mandrel 102, e.g., maintains a coaxial orientation of the sealing element 112 with respect to the mandrel 102. This may ensure that the skirts 206, 208 uniformly engage the mandrel 102, thereby promoting the formation of an effective seal between the sealing element 112 and the inner diameter surface of the mandrel 102.

The bowl 126 may abut an upper end 216 of the encapsulant collar 114, thereby containing the encapsulant within the encapsulant collar 114. As shown, the interior of the bowl 126 may have a tapered (conical) surface 217, which may be tapered in reverse orientation to a tapered outer surface 218 of the generally wedge-shaped gripping members 124, 125. The bowl 126 may also have an axial-facing bottom surface 219.

As the lock nut 104 is advanced toward the mandrel 102 (e.g., by rotating the lock nut 104 relative to the mandrel 102), the lip 128 may press the gripping members 124, 125 into the bowl 126, toward the bottom surface 219, and the tapered engagement between the surfaces 217, 218 may press the gripping members 124, 125 radially inward, into engagement with the armor 138 of the cable 130. The gripping members 124, 125 may include the anti-crush element 220 thereon, which may constrain how far the gripping members 124, 125 may be moved into the bowl 126. As such, the anti-crush element 220 may prevent the gripping members 124, 125 from advancing so far axially into the bowl 126 that they gripping member 124, 125 press radially into the cable 130 with sufficient force to damage the cable 130. However, the anti-crush element 220 may permit the gripping members 124, 125 to tightly engage the cable 130 and prevent the cable 130 from being removed from the wellhead penetrator 100 under normal operating conditions. In an embodiment, the anti-crush element 220 may be a beveled end of the gripping members 124, 125 themselves, or may be another type of extension or a separate piece configured to contact an axially-facing, bottom of the bowl 126 and thereby prevent further axial advancement of the gripping members 124, 125.

Additionally, pressing the gripping members 124, 125 axially by advancing the lock nut 104 may also serve to apply an axial force on the encapsulant that is within the encapsulant collar 114, and within the gap 116, which may cause the encapsulant to fill any empty spaces or voids, and thereby promote an effective seal. Further, such pressure may be transmitted via the encapsulant to the sealing element 112, which in turn presses the encapsulant within the cavity 200, likewise causing the encapsulant to fill any gaps and thereby promote the formation of an effective seal.

Accordingly, there are several differences that permit the omission of the encapsulant, however. For example, the tapered bowl 126 of the locking assembly has an axial sleeve 1302, which may abut the end 106 of the mandrel 102. The sleeve 1302 may be provided in lieu of the encapsulant collar 114 (e.g., FIGS. 1A and 1B), and the encapsulant collar 114 may be omitted, while still providing sufficient spacing to receive and retain the cable 130 within the lock nut 104, and permit the cables 136A-C to extend from the armor 138 and be separated so as to be received through the separate conduits in the sealing element 112. The gap 116 within the mandrel 102, above the sealing element 112 may be empty.

Further, in some embodiments, the backup member 110 and the sealing element 112 may be connected together by molding the (e.g., elastomeric) sealing element 112 directly to the (e.g., metallic) backup member 110. The backup member 110 may engage the shoulder 119, which serves to prevent the backup member 110 from proceeding through the mandrel 102 and out of the open upper end opposite to the lock nut 104. The backup member 110 may be relative rigid as compared to the sealing element 112, and may be closely toleranced with the mandrel 102, including the shoulder 119, so as to prevent the sealing element 112 from extruding therepast in high pressure environments.

Additionally, a debris barrier 1310 may be received into the upper end of the mandrel 102, and may sealed therein. The debris barrier 1310 may not be configured to experience high pressure differentials, but may prevent ingress of contaminants into contact with the components positioned within the mandrel 102.

Accordingly, the cable lock assembly provided by the tapered bowl 126 and the gripping members 124, 125 may grip and retain the cable 130. Further, any axial forces incident on the cable 130 may be transmitted through mandrel 102 to the upper end thereof, so as to resist displacement of the cable 130 with respect to the well head penetrator 1300.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A wellhead penetrator, comprising:

a mandrel having first and second ends;

a lock nut that is adjustably connected to the second end of the mandrel;

a tapered bowl positioned within the lock nut, the mandrel, or both;

a cable lock assembly at least partially received into the mandrel and the lock nut, wherein moving the lock nut in an axial direction relative to the mandrel causes the cable lock assembly to grip a cable received therethrough;

a sealing element positioned at least partially within the mandrel and spaced apart from the tapered bowl;

a backup member positioned adjacent to the sealing element and at least partially within the mandrel, wherein a lower end of the backup member presses against the sealing element so as to prevent misalignment of the sealing element with respect to the mandrel, and wherein the mandrel, the lock nut, the sealing element, and the backup member are configured to receive the cable therethrough; and a debris barrier positioned at least partially within the mandrel, wherein the debris barrier is positioned above the sealing element and the backup member, and wherein the debris barrier is configured to prevent contaminants from entering the mandrel and contacting the sealing element and the backup member.

2. The wellhead penetrator of claim 1, wherein the mandrel defines a shoulder therein, the backup member having a first side that is pressed against the shoulder, and a second side that is engagement with the sealing element, and wherein the shoulder is configured to prevent the backup member from proceeding therepast toward the first end of the mandrel.

3. The wellhead penetrator of claim 1, further comprising an encapsulant collar positioned axially between the sealing element and the tapered bowl, wherein the encapsulant collar and a gap within the mandrel between the encapsulant collar and the sealing element are at least partially filled with first encapsulant.

4. The wellhead penetrator of claim 3, wherein the backup member defines a cavity therein that opens toward the sealing element, the cavity being at least partially filled with a second encapsulant, wherein opposite axial faces of the sealing element are in contact with the first encapsulant and the second encapsulant, respectively so as to prevent leakage of wellbore fluids through the sealing element.

5. The wellhead penetrator of claim 1, wherein the cable lock assembly comprises the tapered bowl and a plurality of reverse-tapered gripping members received at least partially into the tapered bowl, and wherein the gripping members axially engage the lock nut, such that moving the lock nut moves the gripping members relative to the bowl.

6. The wellhead penetrator of claim 5, wherein the lock nut is threaded to the mandrel, and wherein the lock nut includes a lip that axially engages the gripping members, so as to apply an axial force to the gripping members in response to rotating the lock nut relative to the mandrel.

7. The wellhead penetrator of claim 5, wherein the cable lock assembly comprises an anti-crush feature to restrict axial and radial movement of the one or more gripping members in the bowl.

8. The wellhead penetrator of claim 5, wherein the tapered bowl comprises an axially-extending sleeve that extends away from the gripping members and engages an axial end of the mandrel, and wherein the sealing element does not engage an encapsulant.

9. The wellhead penetrator of claim 1, wherein the sealing element comprises a first skirt and a second skirt, the first and second skirts being axially offset and extending radially outward into engagement with the mandrel.

10. The wellhead penetrator of claim 1, further comprising the cable, wherein the cable comprises a plurality of wires and an outer armor through which the plurality of wires extend, the outer armor extending along an armored section of the cable and not extending along an unarmored section of the cable, wherein the armored section is received through the lock nut, and wherein the plurality of wires extend separately from one another in the unarmored section within the mandrel, through the sealing element, and through the backup member.

11. The wellhead penetrator of claim 1, wherein the sealing element, the backup member, and the debris barrier are axially-offset from one another.

12. The wellhead penetrator of claim 1, wherein the backup member is above the sealing element.

13. The wellhead penetrator of claim 1, wherein a lower end of the backup member contacts an upper end of the sealing element.

14. A method, comprising:

receiving a lock nut on a cable;

receiving a sealing element on the cable, axially spaced apart from the lock nut;

receiving a backup member into engagement with the sealing element;

sliding a mandrel over the backup member and the sealing element, such that the sealing element forms a seal within the mandrel and the backup member is prevented from sliding through the mandrel;

positioning a debris barrier at least partially within the mandrel, wherein the debris barrier is positioned above the sealing element and the backup member, and wherein the debris barrier is configured to prevent contaminants from entering the mandrel and contacting the sealing element and the backup member; and connecting the mandrel to the lock nut, wherein connecting comprises:

rotating the lock nut relative to the mandrel, the lock nut and the mandrel each including threads that are engaged and advanced by rotating the lock nut relative to the mandrel; and driving one or more gripping members of a cable lock assembly into a tapered bowl of the cable lock assembly, such that the one or more gripping members apply a radial gripping force onto the cable, to prevent dislocation of the cable relative to the mandrel and the lock nut.

15. The method of claim 14, further comprising:

applying a first encapsulant to the cable and receiving the backup member over the first encapsulant and into a cavity defined within the backup member, wherein the first encapsulant is pressed into engagement with the sealing element.

16. The method of claim 15, further comprising:

sliding an encapsulant collar over the first encapsulant; and applying a second encapsulant to the cable, adjacent to the sealing element, on an opposite side of the sealing element from the first encapsulant, wherein sliding the mandrel comprises sliding the mandrel over first encapsulant, the second encapsulant, and the encapsulant collar.

17. The method of claim 16, further comprising securing the tapered bowl in position against the first encapsulant while sliding the encapsulant collar over the first encapsulant, wherein sliding the encapsulant collar over the first encapsulant comprises causing the encapsulant collar to contact the bowl.

18. The method of claim 16, wherein driving the one or more gripping members by rotating the lock nut applies an axial force to the first encapsulant, the second encapsulant, or a combination thereof.

19. The method of claim 16, wherein sliding the mandrel comprises sliding the mandrel until a lower end of the mandrel contacts a shoulder of the encapsulant collar, such that the encapsulant collar is partially within the mandrel and partially within the lock nut.

20. The method of claim 14, wherein an annular end of the backup member engages the sealing element, to prevent misalignment of the sealing element in the mandrel.

21. The method of claim 14, further comprising receiving the mandrel and the lock nut, including the sealing element and the backup member positioned within the mandrel, the lock nut, or both, within a bore formed in a wellhead, for providing electrical conductivity via the cable through the wellhead.

22. A wellhead penetrator, comprising:

a mandrel having a lower end that is threaded;

a lock nut having an upper end that is threaded into engagement with the lower end of the mandrel, wherein a cable is received through the mandrel and the lock nut, the cable having an armored section and an unarmored section;

a cable lock assembly positioned in the lock nut, wherein the cable lock assembly is configured to grip the armored section of the cable in response to the lock nut being rotated relative to the mandrel;

a sealing element positioned at least partially within the mandrel, wherein the sealing element receives individual wires of the unarmored section of the cable therethrough;

an encapsulant positioned above the sealing element; and a backup member adjacent to the sealing element and at least partially within the mandrel and configured to receive the individual wires of the unarmored section of the cable therethrough, wherein a lower end of the backup member presses against the sealing element so as to prevent misalignment of the sealing element with respect to the mandrel, and wherein the backup member is retained by a shoulder formed in the mandrel and is configured to prevent the sealing element from being misaligned with respect to the mandrel;

wherein the backup member defines a cavity therein that opens toward the sealing element, and wherein the cavity is at least partially filled with the encapsulant.

23. The wellhead penetrator of claim 22, wherein the encapsulant is applied to the cable.

24. The wellhead penetrator of claim 22, wherein a second encapsulant is positioned below the sealing element.

* * * * *